US007865125B2

(12) United States Patent
Moore

(10) Patent No.: US 7,865,125 B2
(45) Date of Patent: Jan. 4, 2011

(54) CONTINUOUS FEED PRINTING SYSTEM

(75) Inventor: Steven R. Moore, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 1169 days.

(21) Appl. No.: 11/474,247

(22) Filed: Jun. 23, 2006

(65) Prior Publication Data

US 2007/0297841 A1 Dec. 27, 2007

(51) Int. Cl.
*G03G 15/00* (2006.01)

(52) U.S. Cl. ..... 399/384; 399/385; 399/387; 399/396; 271/9.1

(58) Field of Classification Search ..... 399/384, 399/385, 387, 396; 271/9.1
See application file for complete search history.

(56) References Cited

U.S. PATENT DOCUMENTS 4,579,446 A 4/1986 Fujino et al.
4,587,532 A 5/1986 Asano
4,836,119 A 6/1989 Siraco et al.
5,004,222 A 4/1991 Dobashi
5,008,713 A 4/1991 Ozawa et al.
5,080,340 A 1/1992 Hacknauer et al.
5,095,342 A 3/1992 Farrell et al.
5,159,395 A 10/1992 Farrell et al.
5,208,640 A 5/1993 Horie et al.
5,272,511 A 12/1993 Conrad et al.
5,326,093 A 7/1994 Sollitt
5,435,544 A 7/1995 Mandel
5,473,419 A 12/1995 Russel et al.
5,489,969 A 2/1996 Soler et al.
5,504,568 A 4/1996 Saraswat et al.
5,525,031 A 6/1996 Fox
5,557,367 A 9/1996 Yang et al.
5,568,246 A 10/1996 Keller et al.
5,570,172 A 10/1996 Acquaviva
5,596,416 A 1/1997 Barry et al.
5,629,762 A 5/1997 Mahoney et al.
5,710,968 A 1/1998 Clark et al.
5,765,481 A * 6/1998 Tortora et al. ..... 101/211
5,778,377 A 7/1998 Marlin et al.
5,884,910 A 3/1999 Mandel
5,995,721 A 11/1999 Rourke et al.
6,059,284 A 5/2000 Wolf et al.
6,125,248 A 9/2000 Moser
6,241,242 B1 6/2001 Munro
6,297,886 B1 10/2001 Cornell
6,341,773 B1 1/2002 Aprato et al.

(Continued)

OTHER PUBLICATIONS

U.S. Appl. No. 10/785,211, filed Feb. 24, 2004, Lofthus et al.

(Continued)

*Primary Examiner*—Judy Nguyen
*Assistant Examiner*—Andy L Pham
(74) *Attorney, Agent, or Firm*—Fay Sharpe LLP

(57) ABSTRACT

A continuous feed (CF) printing module, printing system, and method is provided. The CF printing module comprising an image transfer system configured to selectively mark a media web, and a media web transport system configured to selectively advance a media web without image marking by the image transfer system at a first speed and selectively route a media web for image marking by the image transfer system at a second speed. The first speed greater than the second speed.

7 Claims, 13 Drawing Sheets

U.S. PATENT DOCUMENTS

| | | | | |
|---|---|---|---|---|
| 6,384,918 | B1 | 5/2002 | Hubble, III et al. | |
| 6,450,711 | B1 | 9/2002 | Conrow | |
| 6,476,376 | B1 | 11/2002 | Biegelsen et al. | |
| 6,476,923 | B1 | 11/2002 | Cornell | |
| 6,493,098 | B1 | 12/2002 | Cornell | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,607,320 | B2 | 8/2003 | Bobrow et al. | |
| 6,608,988 | B2 | 8/2003 | Conrow | |
| 6,612,566 | B2 | 9/2003 | Stoll | |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,639,669 | B2 | 10/2003 | Hubble, III et al. | |
| 6,731,898 | B1 * | 5/2004 | Landa et al. | 399/298 |
| 6,786,149 | B1 | 9/2004 | Lomoine | |
| 6,819,906 | B1 | 11/2004 | Herrmann et al. | |
| 6,925,283 | B1 | 8/2005 | Mandel et al. | |
| 6,959,165 | B2 | 10/2005 | Mandel et al. | |
| 6,973,286 | B2 | 12/2005 | Mandel et al. | |
| 7,024,152 | B2 | 4/2006 | Lofthus et al. | |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0126152 | A1 * | 7/2004 | Iida et al. | 399/302 |
| 2004/0150156 | A1 | 8/2004 | Fromherz et al. | |
| 2004/0150158 | A1 | 8/2004 | Biegelsen et al. | |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |
| 2006/0033771 | A1 | 2/2006 | Lofthus et al. | |
| 2006/0039728 | A1 | 2/2006 | deJong et al. | |
| 2006/0066885 | A1 | 3/2006 | Anderson et al. | |
| 2006/0067756 | A1 | 3/2006 | Anderson et al. | |
| 2006/0067757 | A1 | 3/2006 | Anderson et al. | |
| 2006/0114313 | A1 | 6/2006 | Moore | |
| 2006/0114497 | A1 | 6/2006 | Anderson et al. | |
| 2006/0115284 | A1 | 6/2006 | Grace et al. | |
| 2006/0115287 | A1 | 6/2006 | Roof | |
| 2006/0115288 | A1 | 6/2006 | Roof | |

OTHER PUBLICATIONS

U.S. Appl. No. 10/881,619, filed Jun. 30, 2004, Bobrow et al.
U.S. Appl. No. 10/917,676, filed Aug. 13, 2004, Lofthus et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,450, filed Nov. 30, 2004, Lofthus et al.
U.S. Appl. No. 11/000,168, filed Nov. 30, 2004, Biegelsen et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, Sep. 8, 2005, Goodman et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/287,177, filed Nov. 23, 2005, Mandel et al.
U.S. Appl. No. 11/291,583, filed Nov. 30, 2005, Lang.
U.S. Appl. No. 11/291,860, filed Nov. 30, 2005, Willis.
U.S. Appl. No. 11/274,638, filed Nov. 15, 2005, Wu et al.
U.S. Appl. No. 11/287,685, filed Nov. 28, 2005, Carolan.
U.S. Appl. No. 11/317,589, Dec. 23, 2005, Biegelsen et al.
U.S. Appl. No. 11/314,774, filed Dec. 21, 2005, Klassen.
U.S. Appl. No. 11/317,167, filed Dec. 23, 2005, Lofthus et al.
U.S. Appl. No. 11/314,828, Dec. 21, 2005, Anderson et al.
U.S. Appl. No. 11/292,388, filed Nov. 30, 2005, Mueller.
U.S. Appl. No. 11/292,163, Nov. 30, 2005, Mandel et al.
U.S. Appl. No. 11/312,081, filed Dec. 20, 2005, Mandel et al.
U.S. Appl. No. 11/331,627, filed Jan. 13, 2006, Moore.
U.S. Appl. No. 11/341,733, filed Jan. 27, 2006, German.
U.S. Appl. No. 11/359,065, filed Feb. 22, 2005, Banton.
U.S. Appl. No. 11/349,828, filed Feb. 8, 2006, Banton.
U.S. Appl. No. 11/364,685, filed Feb. 28, 2006, Hindi et al.
U.S. Appl. No. 11/363,378, filed Feb. 27, 2006, Anderson et al.
U.S. Appl. No. 11/378,046, filed Mar. 17, 2006, Rizzolo et al.
U.S. Appl. No. 11/378,040, filed Mar. 17, 2006, German.
U.S. Appl. No. 11/403,785, filed Apr. 13, 2006, Banton et al.
U.S. Appl. No. 11/399,100, filed Apr. 6, 2006, Paul.
U.S. Appl. No. 11/417,411, filed May 4, 2006, DeGruchy.
U.S. Appl. No. 11/432,924, filed May 12, 2006, Lieberman et al.
U.S. Appl. No. 11/432,905, filed May 12, 2006, Mongeon et al.
U.S. Appl. No. 11/432,993, filed May 12, 2006, Anderson.
Morgan, P.F., "Integration of Black Only and Color Printers", Xerox Disclosure Journal, vol. 16, No. 6, Nov./Dec. 1991, pp. 381-383.
Desmond Fretz, "Cluster Printing Solution Announced", Today at Xerox (TAX), No. 1129, Aug. 3, 2001.

* cited by examiner

CONTINUOUS FEED PRINTING SYSTEM

CROSS REFERENCE TO RELATED PATENTS AND APPLICATIONS

The following patents/applications, the disclosures of each being totally incorporated herein by reference are mentioned:

U.S. Pat. No. 6,973,286, issued Dec. 6, 2005, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. Application No. US-2006-0012102-A1, published Jan. 19, 2006, entitled "FLEXIBLE PAPER PATH USING MULTIDIRECTIONAL PATH MODULES," by Daniel G. Bobrow;

U.S. Publication No. US-2006-0033771-A1, published Feb. 16, 2006, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. Pat. No. 7,924,152, issued Apr. 4, 2006, entitled "PRINTING SYSTEM WITH HORIZONTAL HIGHWAY AND SINGLE PASS DUPLEX," by Robert M. Lofthus, et al.;

U.S. Publication No. US-2006-0039728-A1, published Feb. 23, 2006, entitled "PRINTING SYSTEM WITH INVERTER DISPOSED FOR MEDIA VELOCITY BUFFERING AND REGISTRATION," by Joannes N. M. deJong, et al.;

U.S. Publication No. US-2006-0039729-A1, published Feb. 23, 2006, entitled "PARALLEL PRINTING ARCHITECTURE USING IMAGE MARKING ENGINE MODULES (as amended)," by Barry P. Mandel, et al.;

U.S. application Ser. No. 11/089,854, filed Mar. 25, 2005, entitled "SHEET REGISTRATION WITHIN A MEDIA INVERTER," by Robert A. Clark, et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/093,229, filed Mar. 29, 2005, entitled "PRINTING SYSTEM," by Paul C. Julien;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/109,566, filed Apr. 19, 2005, entitled "MEDIA TRANSPORT SYSTEM," by Barry P. Mandel, et al.;

U.S. application Ser. No. 11/166,581, filed Jun. 24, 2005, entitled "MIXED OUTPUT PRINT CONTROL METHOD AND SYSTEM," by Joseph H. Lang, et al.;

U.S. application Ser. No. 11/166,299, filed Jun. 24, 2005, entitled "PRINTING SYSTEM," by Steven R. Moore;

U.S. application Ser. No. 11/208,871, filed Aug. 22, 2005, entitled "MODULAR MARKING ARCHITECTURE FOR WIDE MEDIA PRINTING PLATFORM," by Edul N. Dalal, et al.;

U.S. application Ser. No. 11/215,791, filed Aug. 30, 2005, entitled "CONSUMABLE SELECTION IN A PRINTING SYSTEM," by Eric Hamby, et al.;

U.S. application Ser. No. 11/248,044, filed Oct. 12, 2005, entitled "MEDIA PATH CROSSOVER FOR PRINTING SYSTEM," by Stan A. Spencer, et al.; and U.S. application Ser. No. 11/291,583, filed Nov. 30, 2005, entitled "MIXED OUTPUT PRINTING SYSTEM," by Joseph H. Lang;

U.S. application Ser. No. 11/312,081, filed Dec. 20, 2005, entitled "PRINTING SYSTEM ARCHITECTURE WITH CENTER CROSS-OVER AND INTERPOSER BY-PASS PATH," by Barry P. Mandel, et al.;

U.S. application Ser. No. 11/317,589, filed Dec. 23, 2005, entitled "UNIVERSAL VARIABLE PITCH INTERFACE INTERCONNECTING FIXED PITCH SHEET PROCESSING MACHINES," by David K. Biegelsen, et al.;

U.S. application Ser. No. 11/331,627, filed Jan. 13, 2006, entitled "PRINTING SYSTEM INVERTER APPARATUS", by Steven R. Moore;

U.S. application Ser. No. 11/349,828, filed Feb. 8, 2005, entitled "MULTI-DEVELOPMENT SYSTEM PRINT ENGINE", by Martin E. Banton; and U.S. application Ser. No. 11/359,065, filed Feb. 22, 2005, entitled "MULTI-MARKING ENGINE PRINTING PLATFORM", by Martin E. Banton.

BACKGROUND

The present disclosure relates to a continuous feed printing system that integrates one or more printing system modules. A continuous feed (CF) printing system prints on a band or roll of paper as compared to a sheet printing system which prints on discrete sheets of media. FIG. 1 illustrates a continuous feed printing system that incorporates a media roll input 2, media roll input adapter 4, multiple printing modules 6, 8, 10, and 12, a media roll output adapter 14 and a media roll output 16. The media roll input 2 unwinds in a clockwise direction as the web of paper 18 is fed by the input adapter 4 to a first printing module 6. The paper web 18 continues to proceed through the second 8, third 10 and fourth 12 printing modules. The web 18 continues to be processed through the output adapter 14 which feeds the paper web onto a media roll output 16. Any paper cutting required is performed external to the CF printing system illustrated in FIG. 1. Other variations of a CF printing system are available, such as the printing system disclosed in U.S. Pat. No. 6,786,149, issued to Lomoine et al.

Integrated sheet printing systems, such as the system illustrated in FIG. 2 and FIG. 3, serve as platforms for entry level production printing with minimal investment. Integrated systems typically use two or more marking engines 20, 22, and 24 which are modular in design and construction. The marking engines are integrated with a sheet feeder module 26 and a finisher module 28 by way of an integrated track to route individual cut sheets of media from the sheet feeder module 26 to one or more marking engines 20, 22, and 24 for marking. After all marking has been completed the integrated track routes the printed media to the finisher module 28. Cost benefits of this printing system are related to the modularity of the modules used. For example, the marking engines can be configured to include black only, color, custom color and/or monochrome, thereby enabling a user to print a document in the most cost effective manner. In addition, the modules can be removed for service or placement in another printing system relatively easily. One disadvantage of a cut sheet printing system is the necessity to handle media sheets as the production throughput requirements are increased. This increase in media sheet handling capability increases the costs and complexity associated with the cut sheet printing system. This added complexity can contribute to a reduction in the overall reliability of the printing system.

The CF format is advantageous for offset print applications because of its media handling ability. One web of media is processed through a print system from the media roll input to the media roll output. The CF format is very reliable because the web is processed through the printing system as one media sheet. However, conventional CF printing systems can require a sizable investment and do not provide the modularity of an integrated cut sheet printing system as described with reference with FIG. 2. In addition, the web or process speed is dependant on the speed of the marking engine(s) process speed. This limit in web speed is driven by the need for a non-slip interface at the image transfer point of the printing system.

This disclosure provides a modular CF printing system to enable a higher web process speed relative to the CF printing system described with reference to FIG. 1.

INCORPORATION BY REFERENCE

U.S. Pat. No. 6,786,149, issued to Lomoine et al., the entire disclosure which is incorporated by reference, provides a high speed continuous feed printing system.

BRIEF DESCRIPTION

Aspects of the present disclosure, in embodiments thereof, include a printing module comprising an image transfer system configured to selectively mark a media web; and a media web transport system configured to selectively advance a media web without image marking by the image transfer system at a first speed and selectively route a media web for image marking by the image transfer system at a second speed, the first speed greater than the second speed. The printing module is configured to operatively connect to one or more media web buffers, one or more printing modules, or a printing module and a media web buffer, and the printing module is configured to advance a first predetermined length of a media web at the first media web speed, the first predetermined length of the media web advanced without image marking by the image transfer system, and the printing module is configured to subsequently image mark a second predetermined length of the media web at the second media web speed.

Another exemplary embodiment of the present disclosure includes a printing system comprising a first printing module comprising an image transfer system configured to selectively mark a media web; and a media web transport system configured to selectively advance a media web without image marking by the image transfer system at a first speed and selectively route a media web for image marking by the image transfer system at a second speed, the first speed greater than the second speed; a media web input; and a media web output. The exemplary embodiment further comprising a first media web buffer comprising a media web input; a media web queuing space; and a media web output; wherein the first printing module media web output is operatively connected to the first media web buffer media web input.

Another exemplary embodiment of the present disclosure includes a media web printing method comprising advancing at a first speed a predetermined length of media web to a first media web buffer, the media web buffer operatively connected to first and second printing modules, wherein the first media web buffer feeds the second printing module; feeding the predetermined length of media web from the first media web buffers to the second printing module for image marking the media web at a second speed, the first speed greater than the second speed; and image marking the predetermined length of media web from the first media web buffer at the second speed.

Another exemplary embodiment of the present disclosure includes a xerographic printing system comprising a first printing module comprising an image transfer system configured to selectively mark a media web; and a media web transport system configured to selectively advance a media web without image marking by the image transfer system at a first speed and selectively route a media web for image marking by the image transfer system at a second speed, the first speed greater than the second speed; a media web input; and a media web output. The exemplary embodiment further comprising a first media web buffer comprising a media web input; a media web queuing space; and a media web output, wherein the first printing module media web output is operatively connected to the first media web buffer input; and wherein the printing system is configured to receive a first predetermined length of media web from a media web roll at a first speed, store the first predetermined length of media web substantially within the media web buffer, and subsequently image mark the first predetermined length of media web at a second speed, the first speed greater than the second speed.

DETAILED DESCRIPTION

This disclosure provides a printing system to image mark a continuous feed (CF) media or media web. The CF media passes through the printing system from an input media web feeder roll or spool to a take-up finishing media roll output or spool. To facilitate image marking the media web, one or more printing modules and one or more media web buffers are integrated along the media web path. The printing module/media web buffer arrangements disclosed provide a printing system which operates at multiple speeds, whereby a first media web travel speed is utilized to advance the media roll and load the printing system media web buffers, and a second, relatively slower speed, is utilized to image mark the media web.

In operation, the disclosed printing system advances a predetermined length of media web to one or more media web buffers at a relatively high speed while the printing system printing modules operate in a non-image marking mode, media web pass through mode and/or media web bypass mode. Subsequently, the media web is image marked by the printing modules at a relatively lower speed until the media web buffer is substantially unloaded. At this point, the cycle repeats and the media web is advanced at the relatively higher speed until the media web buffers are substantially loaded.

The printing system substantially described above, provides a printing system configuration to increase the throughput of a CF printing system relative to a CF printing system which only operates at the relatively slower speed of the printing module required for image marking a media web.

Figure 1:
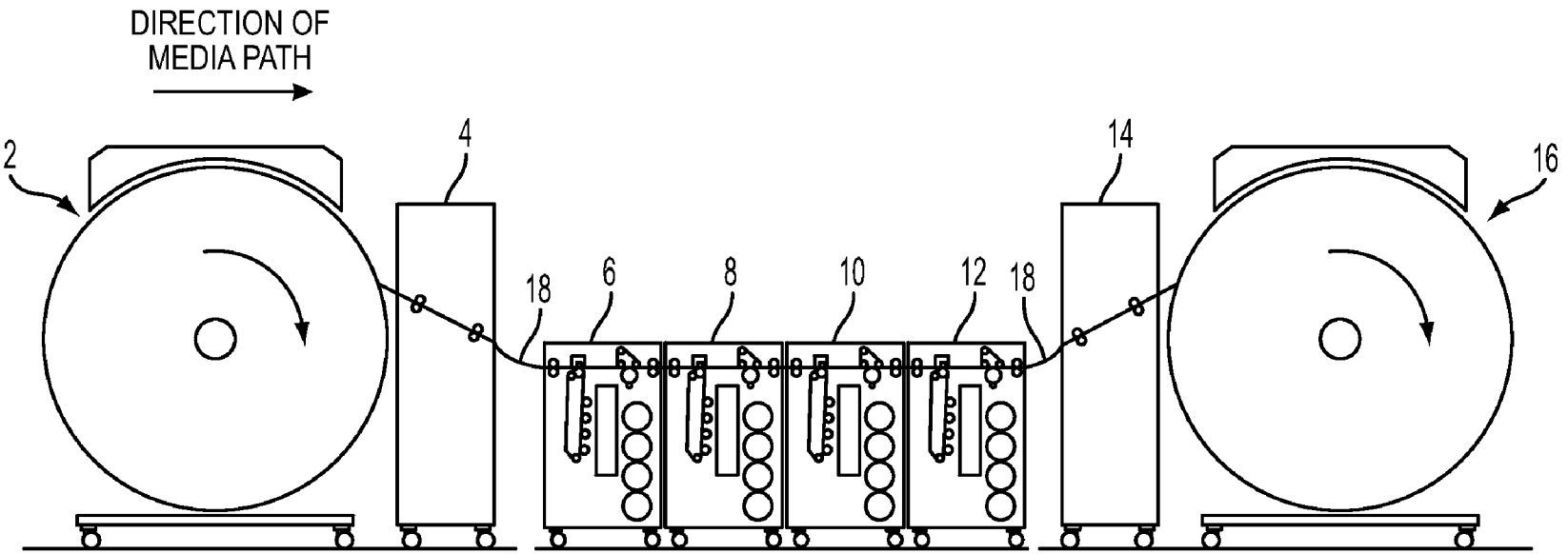
FIG. 1 PRIOR ART
FIG. 1 illustrates a modular CF printing system.
Figure 2:
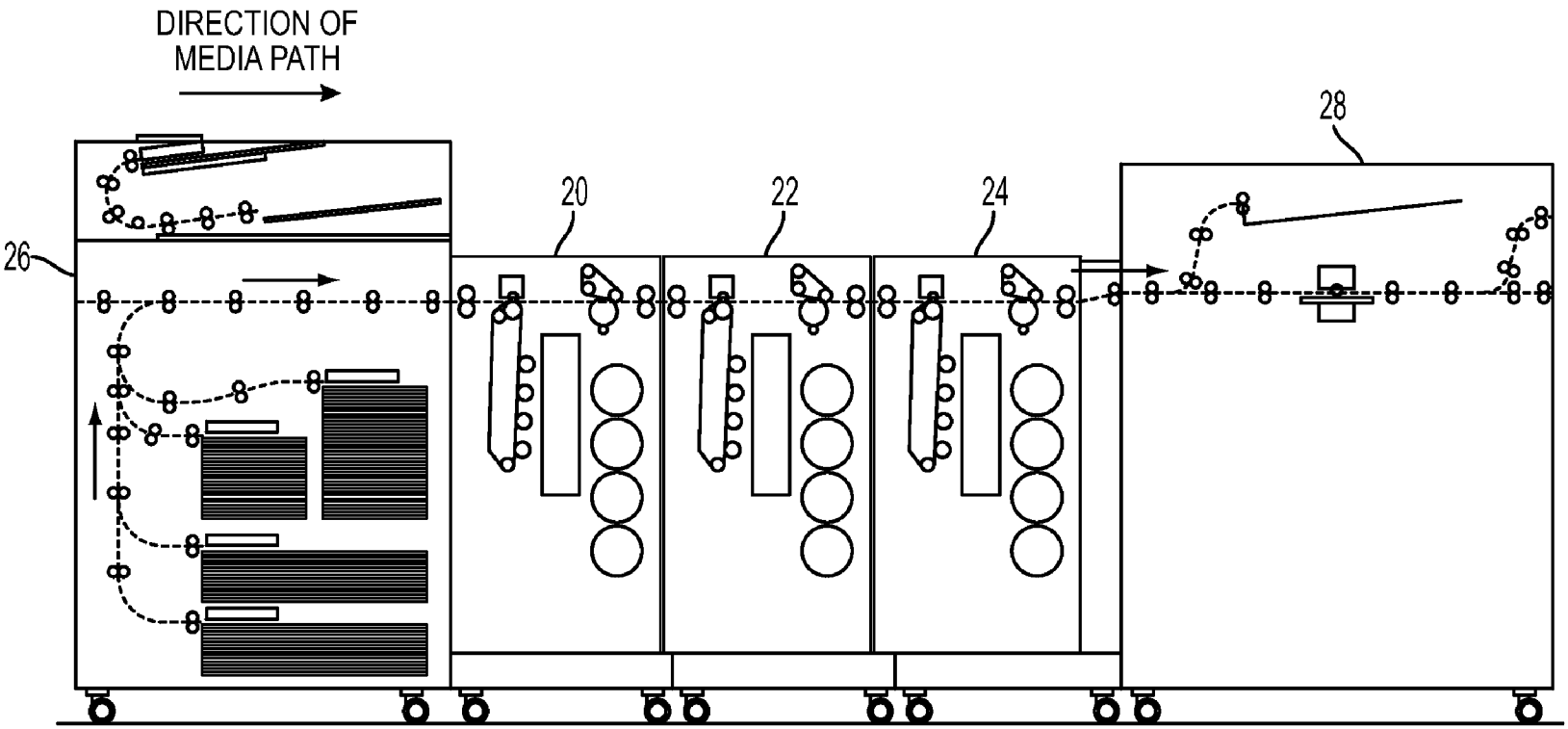
FIG. 2 PRIOR ART
FIG. 2 illustrates a cut sheet printing system.
Figure 3:
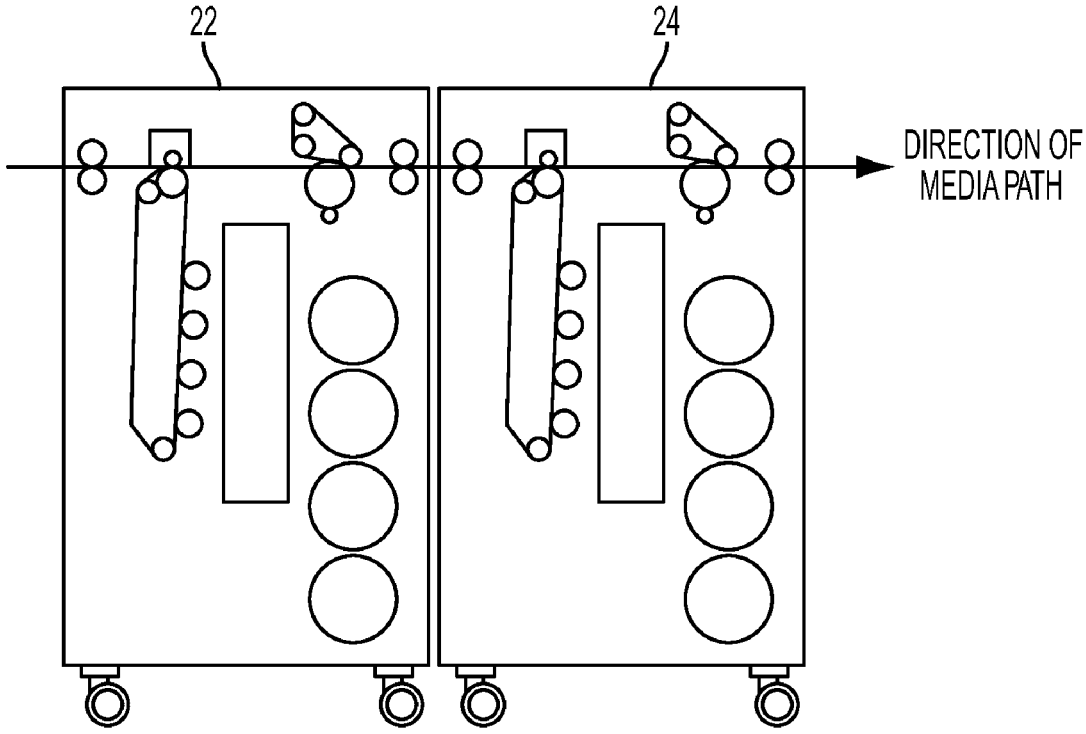
FIG. 3 PRIOR ART
FIG. 3 illustrates two printing modules horizontally aligned.
Figure 4:
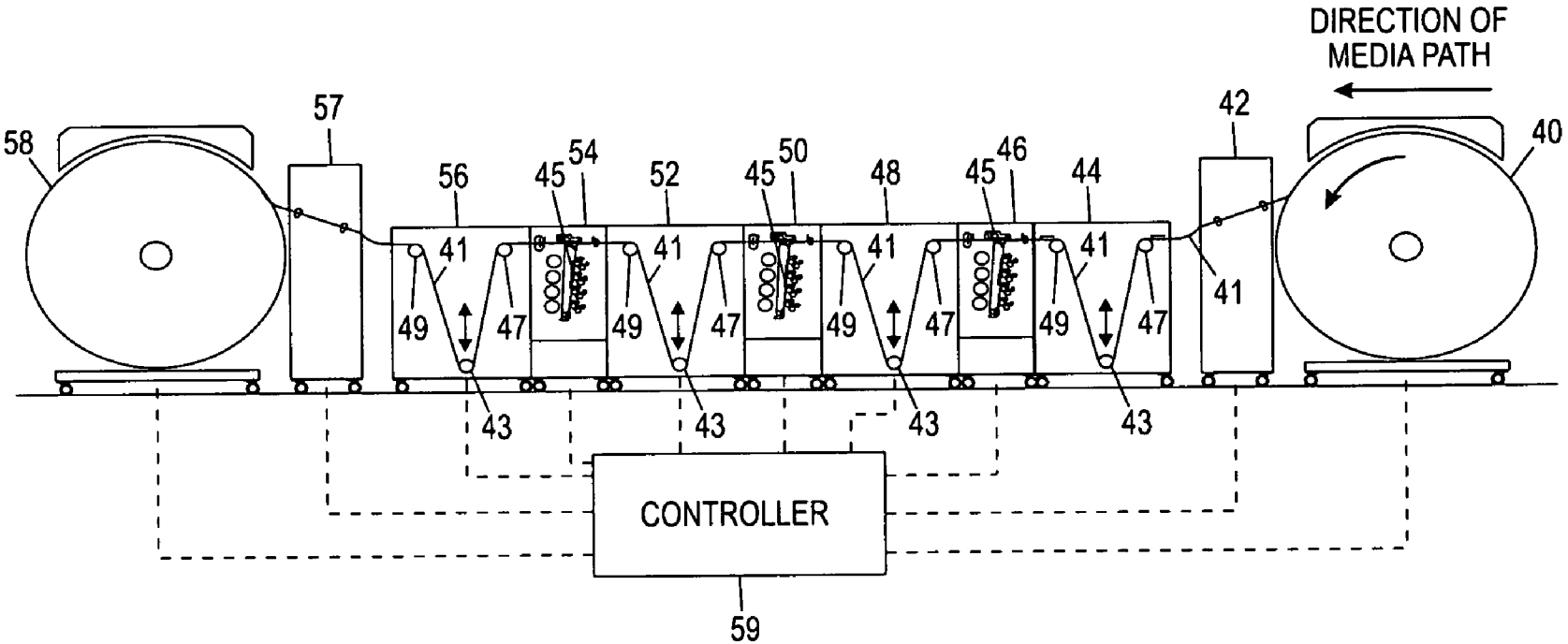
FIG. 4 illustrates a CF printing system according to an exemplary embodiment of this disclosure.

With reference to FIG. 4, illustrated is a printing system according to an exemplary embodiment of this disclosure. The printing system includes a media web feeder roll 40, a media web roll input adapter 42, a first media web buffer 44, a first printing module 46, a second media web buffer 48, a second printing module 50, a third media web buffer 52, a third printing module 54, fourth media web buffer 56, a media web roll output adaptor 57, a media roll output 58 and a controller 59. Each printing module 46, 50 and 54, includes an image transfer system 45.

As illustrated, the direction of the media path is from the right to the left of FIG. 4. As will be known to those of skill in the art, various configurations of this disclosed printing system can be used to provide a CF printing system. For example, the CF printing system illustrated in FIG. 4 may optionally be aligned and configured to provide a media path direction from left to right as viewed from the perspective of FIG. 4.

Initially, the printing system illustrated in FIG. 4 is setup for operation by feeding a media web from the media web feeder roll 40 through the media web input adapter 42, the first media web buffer 44, the first printing module 46, the second media web buffer 48, the second printing module 50, the third media web buffer 52, the third printing module 54, the fourth media web buffer 56, and the media web roll output adapter 57, respectively. Finally, the media web 41 is attached to the media roll output 58 to complete the initial feeding of the media web before operation begins.

In operation, the CF printing system substantially operates as follows:

The media web feeder roll 40 rotates in a counterclockwise direction at a first speed to load the first media web buffer 44, second media web buffer 48, third media web buffer 52 and fourth media web buffer 56. In one embodiment of this disclosure, the sequence of loading the media web buffers comprises first loading the fourth media web buffer 56, subsequently loading the third media web buffer 52, subsequently loading the second media web buffer 48 and lastly loading the first media web buffer 44. Other variations of loading the media web buffers include simultaneously loading all media web buffers or loading the first media web buffer 44 initially, and sequentially loading the second media web buffer 48, the third media web buffer 52 and the fourth media web buffer 56, respectively.

To achieve loading of the media web buffers, a media web buffer variable path length roller 43 can be initially aligned substantially horizontally with the media web buffer input roller 47 and the media web buffer output roller 49. To load a media web buffer, the variable path length roller 43 drives the media web downward as the media web is fed or advanced into the media web buffer. By driving the variable path length roller 43 downward, the media web path is lengthened within the buffer. The maximum media web path will be achieved with the variable path length roller 43 positioned substantially at the lowest position of the media web buffer, as is illustrated in FIG. 4. By controlling the variable path length roller 43, a predetermined length of media web can be loaded into the media web buffer. Other buffer configurations are known to those of skill in the art and are within the scope of this disclosure. For example, the variable path length roller 43 discussed above can be fixed, whereby the media web buffers are preconfigured to load a specific length of media web.

After the media web buffers are loaded with a predetermined length of media web 41 at a first speed, the printing system is ready to image mark the media web 41 at a second, relatively slower, speed. This relatively slower speed is required by the printing modules for proper printing or image marking.

Image marking of the media web 41 commences and the first printing module 46, second printing module 50 and third printing module 54 simultaneously image mark the media web previously loaded into the first media web buffer 44, second media web buffer 48 and third media web buffer 52, respectively. As each printing module image marks the media web 41, the printing module output is fed into the respective upstream media web buffer. In other words, the first printing module 46 image marks the predetermined length of media web previously loaded in the first media web buffer 44 and outputs the image marked predetermined length of media web to the second media web buffer 48. Simultaneously, the second printing module 50 image marks the predetermined length of media web previously loaded in the second media web buffer 48 and outputs the image marked predetermined length of media web to the third media web buffer 52. Simultaneously, the third printing module 54 image marks the predetermined length of media web previously loaded in the third media web buffer 52 and outputs the image marked predetermined length of media web to the fourth media web buffer 56.

After the printing modules have simultaneously image marked the respective media web previously loaded in the media buffers, the media web 41 accelerates to the first, relatively faster, speed and advances the media web to load the media web buffers with media from the feeder roll 40 for subsequent printing and/or image marking. At this stage of the printing operation, the cycle repeats and the printing modules image mark the predetermined lengths of media web previously loaded in the media web buffers. A controller 59 provides the necessary sequencing of operations.

Substantially, the CF printing system of this disclosure has been described heretofore. Variations of the printing system illustrated in FIG. 4 are within the scope of this disclosure and will be provided. However, it is to be understood other CF printing configurations which include one or more printing modules configured to advance a predetermined length of media web at a first speed and image mark a predetermined length of media web at a second, relatively slower, speed will be known to those of skill in the art upon the reading of this disclosure. In addition, the CF printing system of FIG. 4 has been described with the inclusion of media web buffer 44 and media web buffer 56. These media web buffers are optional. When the first printing module 46 image marks the predetermined length of media web directly from the media web feeder roll 40, media web input adapter 42 or combination thereof, the first media web buffer 44 is not required. When the third printing module 54 outputs the image marked predetermined length of media web from its respective input media web buffer 52 to the media roll output adapter 57, media roll output 58, or combination thereof, the fourth media web buffer 56 previously described is not required.

In addition, a CF printing system according to this disclosure may be configured to include a first printing module, a media web buffer and a second printing module, wherein the media web buffer is operatively connected to the output of the first printing module and the input of the second printing module. A media web feeder roll feeds the first printing module and a media roll output receives the image marked media web from the second printing module. The operation of this two printing module and one media web buffer arrangement is substantially equivalent to the description provided above with reference to FIG. 4, except the number of media web buffers loaded with a predetermined length of media web and the number of printing modules simultaneously image marking the predetermined lengths of media web loaded in the respective media web buffers.

Moreover, the scope of this disclosure includes a CF printing system configuration including four or more printing modules operatively connected with three or more media web buffers.

To provide a comparison of expected printing efficiency as a function of the number of printing modules integrated within a CF printing system as described with reference to FIG. 4, below is a table representing a first order timing analysis.

| | | # of Printing Modules | | | | | | | | |
|---|---|---|---|---|---|---|---|---|---|---|
| | | 2 | 3 | 4 | 5 | 6 | 7 | 8 | 9 | 10 |
| # of Consecutive Prints for each Printing Module | 1 | 0.809 | 0.764 | 0.723 | 0.687 | 0.654 | 0.624 | 0.597 | 0.572 | 0.549 |
| | 2 | 0.839 | 0.791 | 0.747 | 0.709 | 0.674 | 0.642 | 0.613 | 0.587 | 0.562 |
| | 3 | 0.850 | 0.800 | 0.756 | 0.716 | 0.680 | 0.648 | 0.619 | 0.592 | 0.567 |
| | 4 | 0.855 | 0.805 | 0.760 | 0.720 | 0.684 | 0.651 | 0.622 | 0.594 | 0.570 |
| | 5 | 0.859 | 0.808 | 0.763 | 0.722 | 0.686 | 0.653 | 0.623 | 0.596 | 0.571 |
| | 6 | 0.861 | 0.810 | 0.764 | 0.724 | 0.687 | 0.654 | 0.624 | 0.597 | 0.572 |
| | 7 | 0.863 | 0.811 | 0.766 | 0.725 | 0.688 | 0.655 | 0.625 | 0.598 | 0.573 |
| | 8 | 0.864 | 0.812 | 0.767 | 0.726 | 0.689 | 0.656 | 0.626 | 0.598 | 0.573 |
| | 9 | 0.865 | 0.813 | 0.767 | 0.726 | 0.690 | 0.656 | 0.626 | 0.599 | 0.574 |
| | 10 | 0.865 | 0.814 | 0.768 | 0.727 | 0.690 | 0.657 | 0.627 | 0.599 | 0.574 |

Note:
The table represents printing efficiency calculated as % of total time printing.

The above data/analysis assumes the media web speed is 3 m/s when advancing the media web to load the media web buffers, the printing module image marking speed is 0.22 m/s, and the acceleration rate is +1-3 g's. As illustrated in the table above, the more printing modules added to the printing system, the lower the average printing efficiency for a particular number of consecutive prints per printing module. This is due to the printing system requiring more time to slew or advance the web for loading media web buffers associated with the respective printing modules.

Comparatively, as the predetermined length of media web, i.e. consecutive prints per printing module, image marked by the printing modules increases, the printing efficiency increases.

Figure 5:
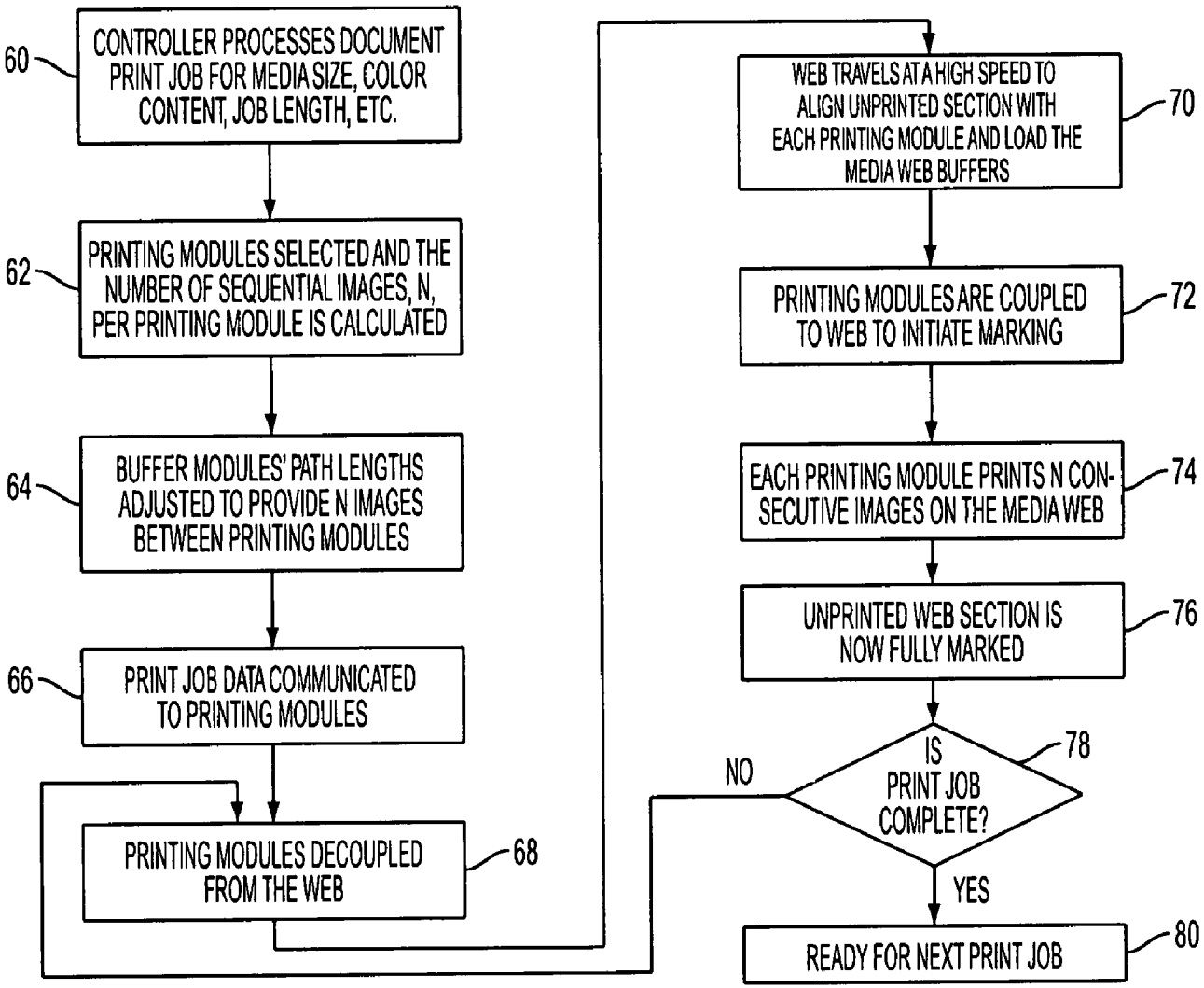
FIG. 5 illustrates a CF printing method according to an exemplary embodiment of this disclosure.

FIG. 5 illustrates a method of operating a continuous feed printing system as discussed with reference to FIG. 4.

Initially, the controller processes a document print job for media size color content, job length, etc. 60. Based on these print job attributes, printing modules are selected and the number of sequential images, N, per printing module is calculated 62. Next, the buffer modules' path lengths are adjusted to provide a predetermined length of media web to provide N images between the printing modules. Subsequent to step 64, the print job data is communicated to the printing modules 66.

To begin the CF printing cycle discussed with reference to FIG. 5, the printing modules are decoupled from the media web 68 to subsequently advance the media web at a relatively high speed to load the media web buffers and align the media web within each printing module for image marking 70. Next, the printing modules are coupled to the media web for image marking 72.

From this point, the media web travels at the image marking speed, which is relatively slower than the media web advancing speed. With the printing modules coupled to the media web, each printing module image marks or prints N consecutive images on the media web 74, whereby the predetermined length of media web previously loaded into the media buffers is fully marked with consecutive images 76.

Subsequently, the controller determines if the print job is complete 78. If the print job is not complete, the CF printing system method decouples the printing modules from the media web 68 for advancement of the media web 70 as previously described and the cycle repeats until the print job is complete.

Once the print job has been completed, the CF printing system remains in an idle state ready for the next print job 80.

Figure 6:
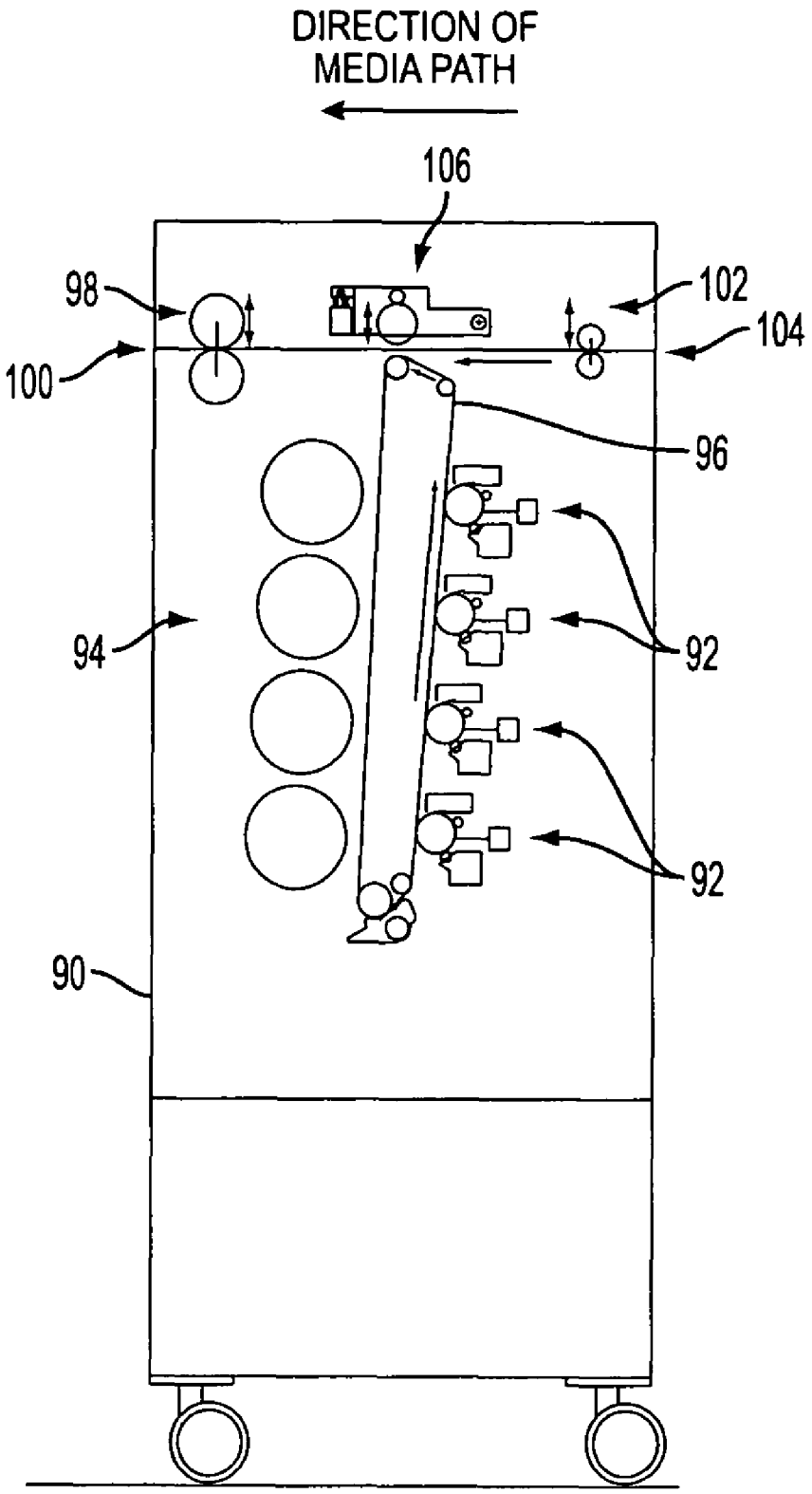
FIG. 6 illustrates a CF printing module according to an exemplary embodiment of this disclosure.

FIG. 6 illustrates a CF color printing module according to an exemplary embodiment of this disclosure. The printing module 90 comprises color marking elements 92, toner supply containers 94, an intermediate image transfer mechanism 96, a fuser 98, a media web output 100, a media web input nip 102, a media web input 104 and an image transfer mechanism 106. The media web travels from right to left as viewed from the perspective of FIG. 6.

Figure 8:
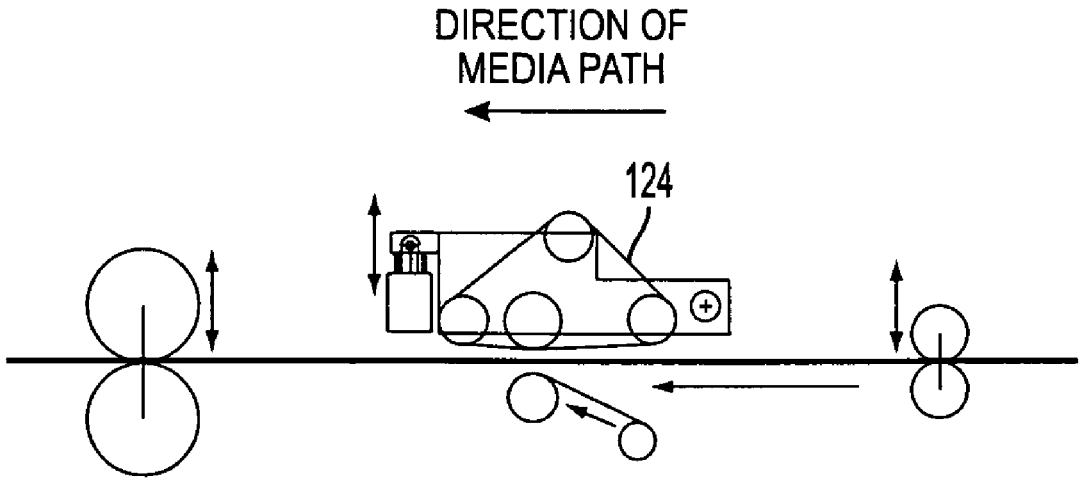
FIG. 8 illustrates a printing module image transfer mechanism according to an exemplary embodiment of this disclosure.
Figure 9:
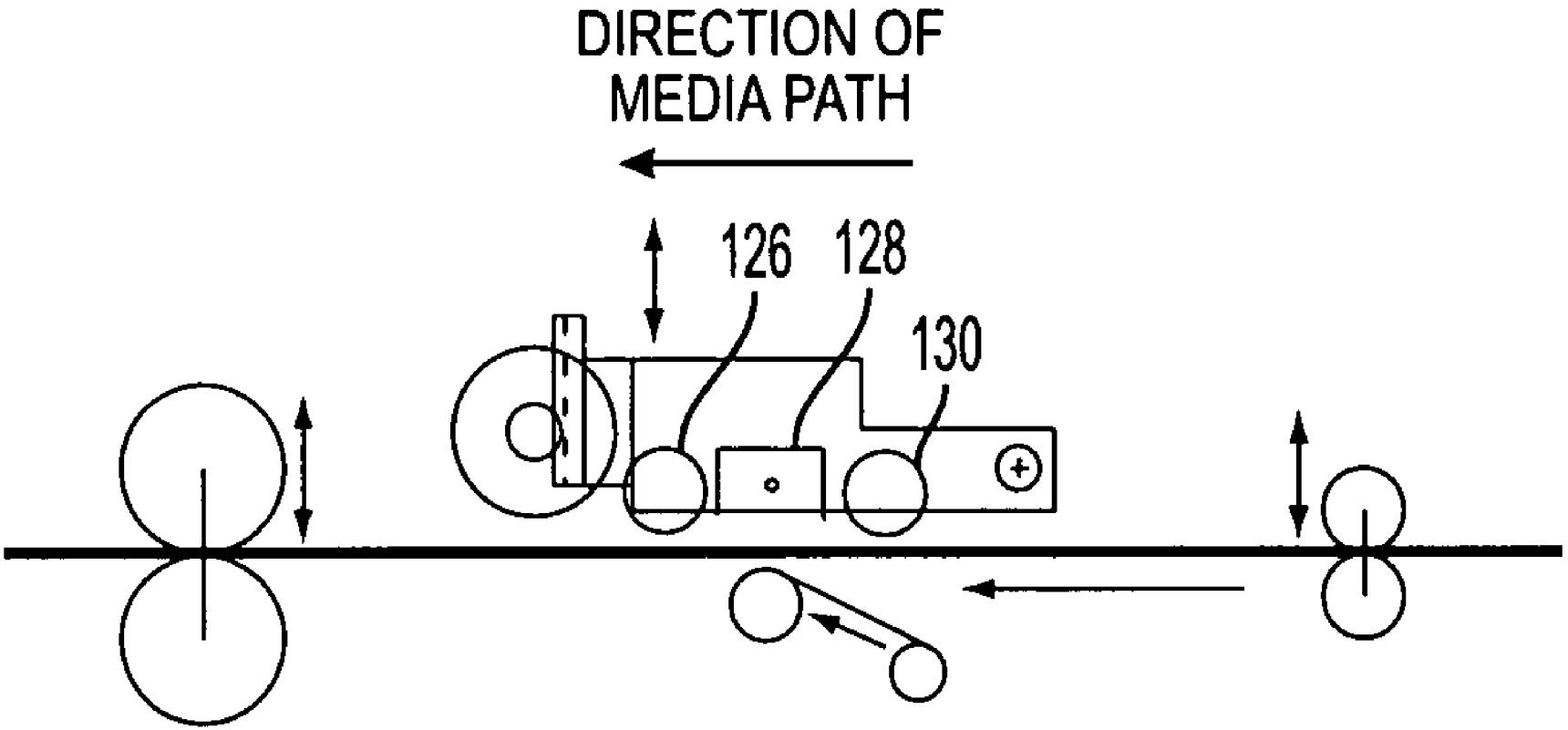
FIG. 9 illustrates a printing module image transfer mechanism according to an exemplary embodiment of this disclosure.

It should be noted the bias transfer roll image transfer mechanism illustrated in FIG. 5 and FIG. 6 are one example of a printing module arrangement to provide media web decoupling/coupling for advancement of the media web at a first speed and subsequently image marking the media web at a second, relatively slower, speed as described heretofore. Other media web/printing module decoupling/coupling configurations are within the scope of this disclosure. For example, FIG. 8 illustrates a bias transfer belt image transfer mechanism, FIG. 9 illustrates a corona device image transfer mechanism, FIGS. 10-14 illustrate a printing module including a primary and secondary image transfer belt arrangement, and FIG. 15 illustrates an image transfer drum arrangement. The details of these image transfer mechanism arrangements are now provided.

Figure 7:
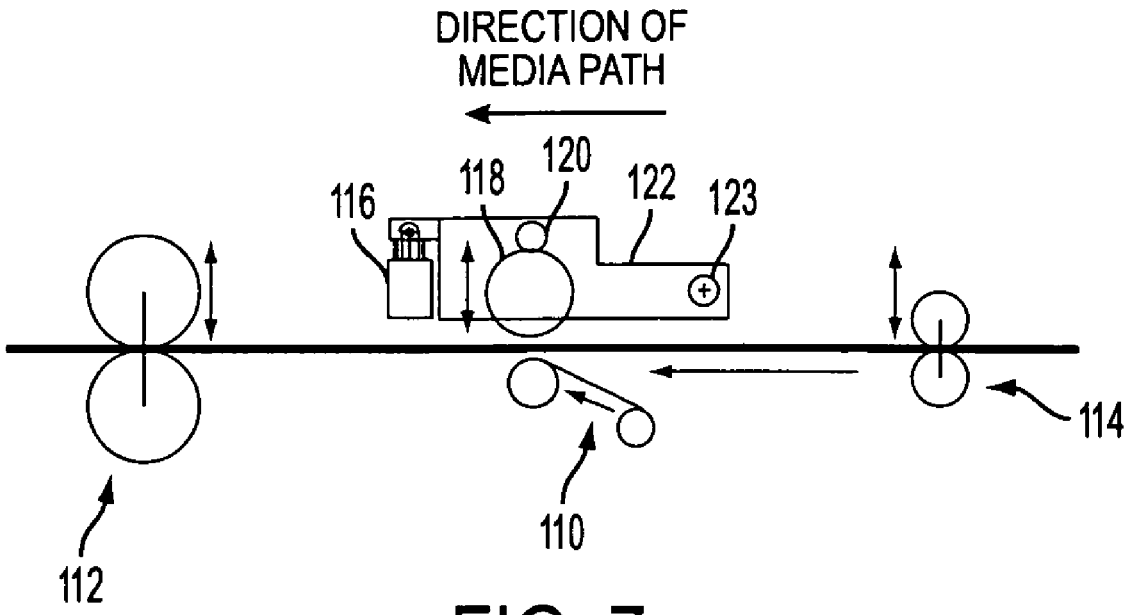
FIG. 7 illustrates a printing module image transfer mechanism according to an exemplary embodiment of this disclosure.

With reference to FIG. 7, illustrated is a more detailed view of the image transfer mechanism provided in FIG. 4 and FIG. 6. The image transfer mechanism comprises an image transfer belt 110, a fuser nip with a camming mechanism 112, a media web input nip with a camming mechanism 114, a solenoid 116, a bias transfer roll 118, a bias transfer roll cleaner 120, a Media web image transfer mechanism frame 122 and an associated frame pivot point 123. In operation, decoupling the image marking mechanism from the media web is provided by pivoting the image transfer mechanism frame 122 about the frame pivot point 123 in an upwardly motion, the solenoid 116 providing the necessary force. In addition, the fuser nip 112 and media input nip 114 are controlled via their respective camming mechanisms to decouple from the media web.

With the fuser nip 112, media input nip 114 and bias transfer roll 118 disengaged/decoupled from the media web, the media web is accelerated to the relatively higher media web advancement speed to load the media web buffers associated with the CF printing system.

For image marking the media web, the fuser 98, media input nip camming mechanism 114 and bias transfer roll 118 are actuated to couple the media web to the image transfer mechanism. Specifically, the fuser nip 98 and media input nip camming mechanism 114 produce the downward force necessary to maintain the proper media web speed for image marking by the bias transfer roll 118/image transfer belt 110 arrangement. The solenoid 116 pivots the image transfer mechanism frame 122 about the frame pivot point 123 and downwardly, thereby coupling the media web with the bias transfer roll 118/image transfer belt 110 arrangement. The image is transferred to the media web from the image transfer belt 110.

FIG. 8 illustrates another image transfer mechanism according to an exemplary embodiment of this disclosure. The image transfer mechanism operates similarly to the image transfer mechanism of FIG. 7, except a bias transfer belt 124 is substituted for the bias transfer roll 118 previously described.

FIG. 9 illustrates another image transfer mechanism according to an exemplary embodiment of this disclosure. Image transfer to the media web is provided by a corona device 128. To decouple/couple the media web from the corona device 128, backing rolls 126 and 130 provide the necessary movement of the image transfer mechanism frame.

Figure 10:
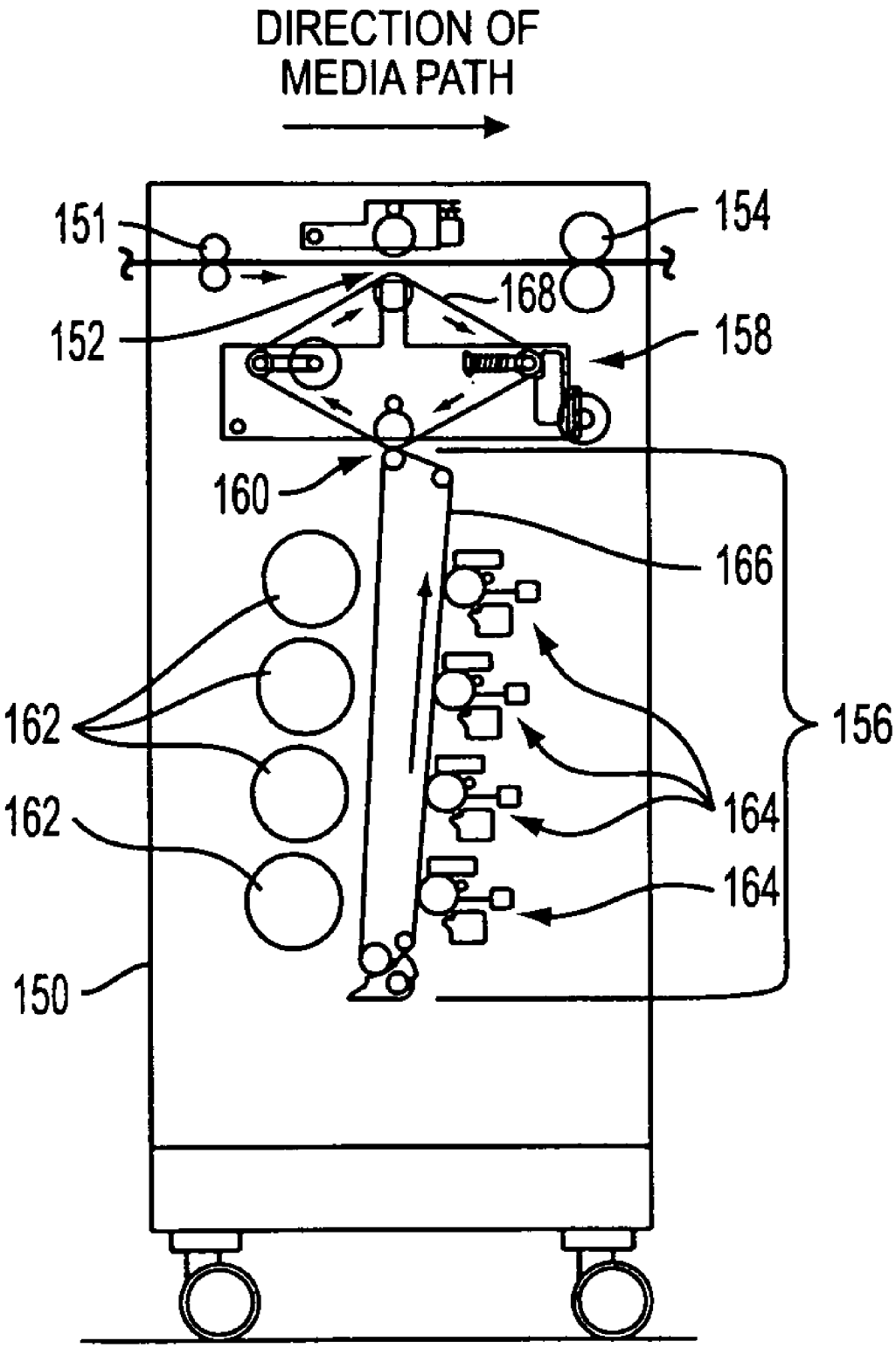
FIG. 10 illustrates a printing module image transfer mechanism according to an exemplary embodiment of this disclosure.

With reference to FIG. 10, a detailed description of another exemplary printing module is provided. The exemplary printing module includes a frame 150 which houses the printing module members. The frame can be segregated into one or more parts which independently house separate functions of the printing module. A multiple frame structure provides additional modularity or flexibility for the overall CF printing system. In addition, the exemplary printing module illustrated in FIG. 10 includes a media web transport input 151, a media web image transfer point 152, a media web transport output 154, a primary image transfer system 156, a secondary image transfer system 158 and an intermediate image transfer point 160 to couple the primary and secondary image transfer systems. The printing module of FIG. 10 also includes four toner supply containers 162 and photoreceptors 164. The number and type of toner supply containers 162 are selected depending on the printing capability desired. For example, four toner supply containers 162 enable CMYK color printing, however, for black text printing, only one toner supply container 162 is required.

Figure 11:
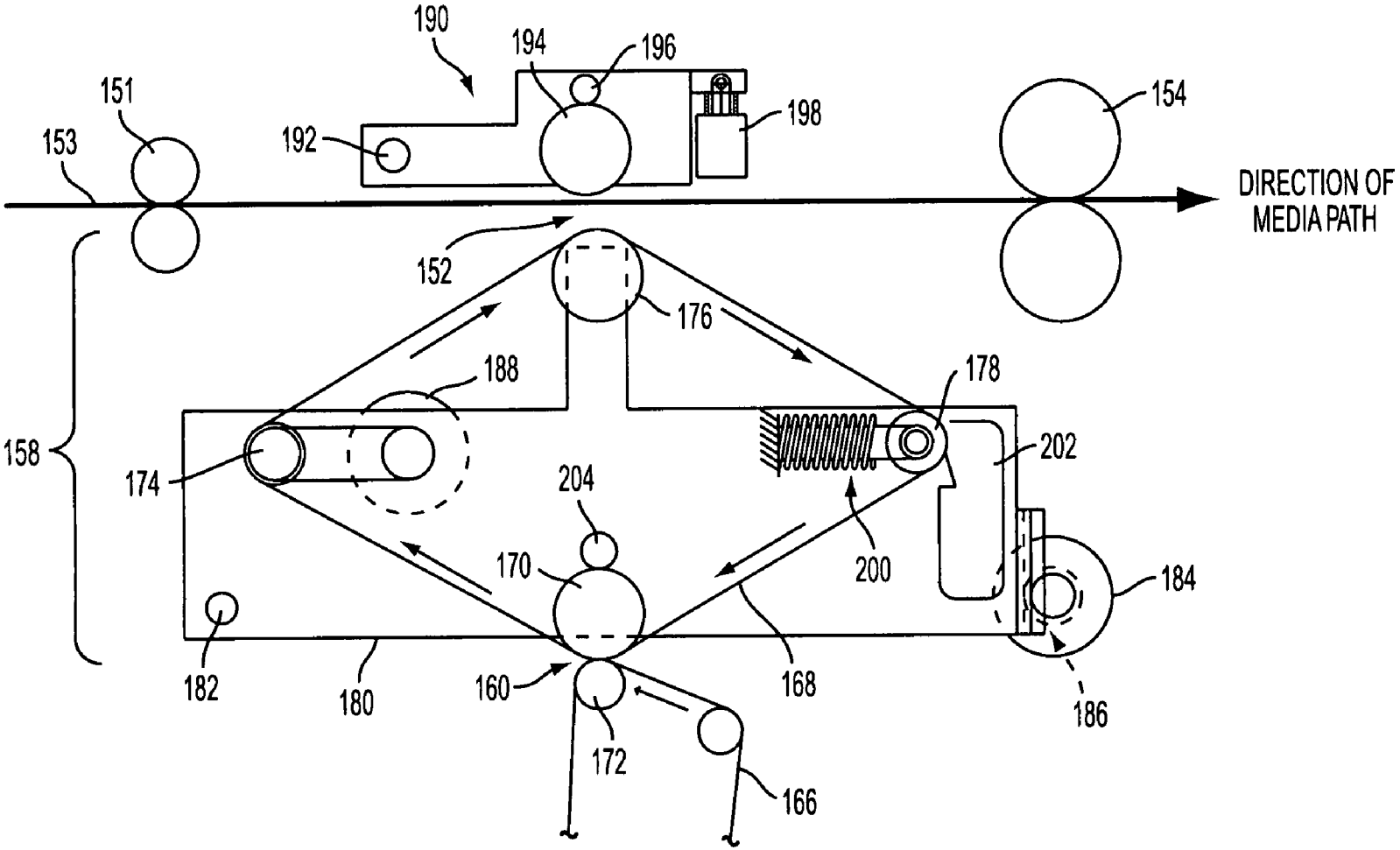
FIG. 11 illustrates a CF printing module image transfer mechanism according to an exemplary embodiment of this disclosure.

The printing module operates by the primary image transfer belt 166 accepting color separation images from each of the four photoreceptors 164. The primary image transfer belt 166 subsequently transports the resultant 4-layer image to the intermediate transfer point 160. An image transfer is completed at the intermediate image transfer point 160 coupling the primary image transfer system 156 and secondary image transfer system 158. As illustrated in FIG. 10, the primary image transfer belt 166 and a secondary image transfer belt 168 are driven such that the belts are in contact at the intermediate image transfer point 160. The belts are driven in the same direction and at the same speed. As illustrated in FIG. 11, the primary and secondary image transfer belts 166 and 168 respectively, are routed between a bias transfer roll 170 housed within the secondary image transfer system 158 and a roll 172 mounted within the primary image transfer system.

A drive roll 174 drives the secondary image transfer belt 168 at the primary image transfer belt 166 speed to accomplish the image transfer. In addition to the bias transfer roll 170 and drive roll 174, in one exemplary embodiment the secondary image transfer belt 168 is routed along a fixed idler roll 176 and a tension roll 178, respectively. The rolls are mounted to a frame 180 which includes a frame pivot point 182 and is adapted to pivot about the frame pivot point 182. After the image has been transferred to the secondary image transfer belt 168, the frame 180 is pivoted upwardly to decouple the primary and secondary image transfer belts. One exemplary embodiment includes an electromechanical drive motor 184 and gear assembly 186 attached to the frame for actuating an upward movement of the frame 180. The pivot motor 184 and associated hardware provide a means for decoupling/coupling the media web from the image transfer system. With the image transferred to the secondary image transfer belt 168, the drive roll 174 is accelerated by an electromechanical drive motor 188 to the speed of the media web. The secondary image transfer system frame 180 is pivoted upwardly to couple the media web 153 and secondary image transfer belt 168 for transferring the image to the media at the media web image transfer point 152.

As referenced in FIG. 11, the media web image transfer point 152 includes a media web transfer frame 190 including a frame pivot point 192, a media web bias roll 194, a bias charge roll 196 and an electromechanical member 198 such as a solenoid mechanism to transfer an image to the media. The media web transfer frame 190 is pivoted downwardly by the solenoid mechanism 198 toward the secondary image transfer belt 168. The media web 153 runs in contact with the media web bias roll 194 and the secondary image transfer belt 168 to provide the image transfer. Subsequent to this image transfer, the media web transfer frame 190 is pivoted upwardly by the solenoid mechanism 198 and the secondary image transfer frame 180 is pivoted downwardly; these pivot motions disengage or decouple the media web 153 from the image transfer process. Subsequently, the marked media is run through a media web transport output 154 which may include a roller and/or fuser. The media web continues to run at the web speed and may be optionally marked with images using other printing modules integrated with the system.

Subsequent to the disengagement and decoupling of the secondary image transfer belt 168 from the media web 153, the secondary image transfer belt 168 is decelerated to the speed of the primary image transfer belt 166 and an image is transferred from the primary image transfer system to the secondary image transfer system as previously described.

The image transfer cycles are repeated to provide a continuous feed printing system. Other features that may be incorporated to the secondary image transfer system include a belt tensioning device 200, a belt cleaner 202 and a bias charge roll 204.

Figure 12:
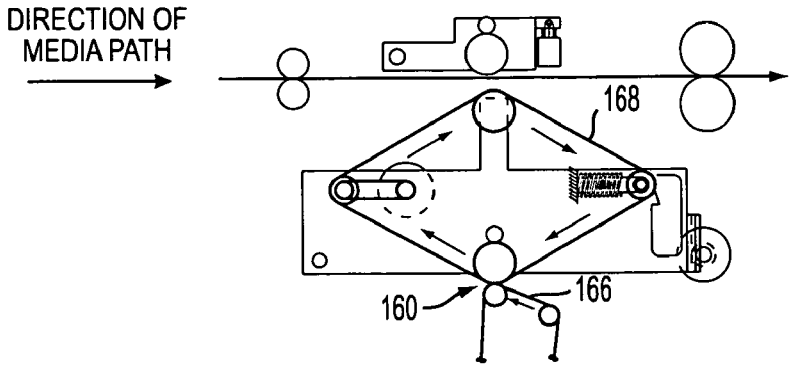
FIGS. 12-14 are detailed representations of the image transfer system illustrated in FIG. 11.
Figure 13:
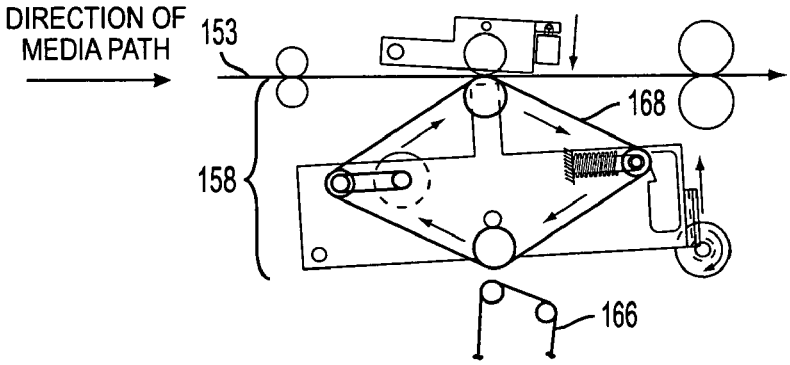
Figure 14:
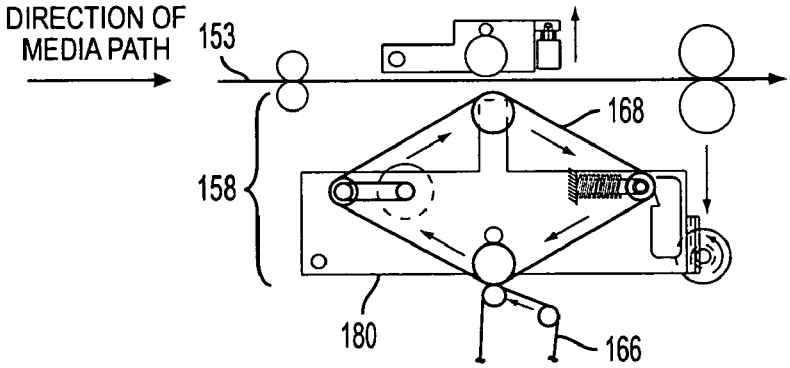
Figure 15:
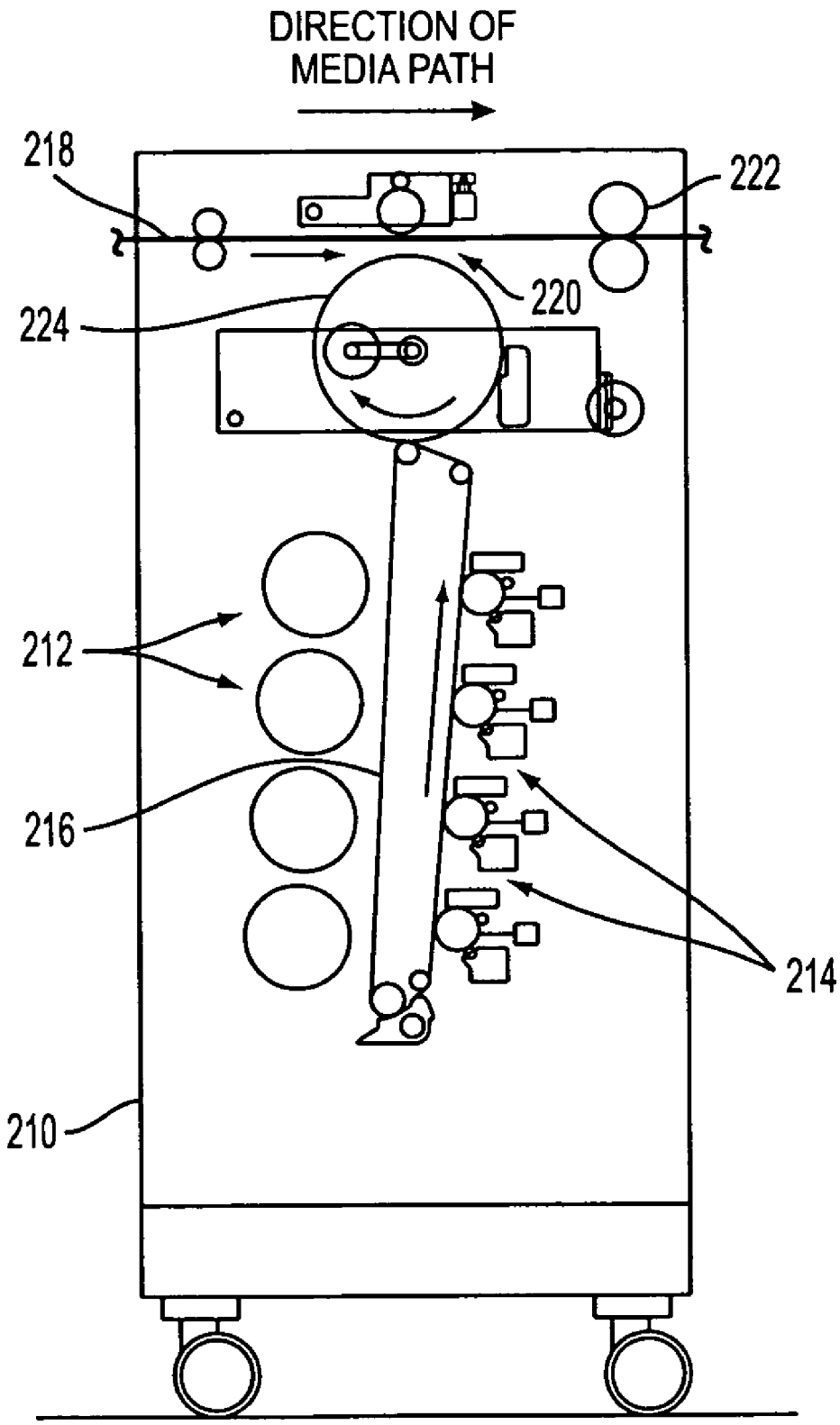
FIG. 15 illustrates a CF printing module according to an exemplary embodiment of this disclosure.

FIGS. 12, 13 and 14 provide further illustrations to describe the secondary image transfer system 158. Referring to FIG. 12, this illustration represents the secondary image transfer belt operating at the speed of the primary image transfer belt 166 and accepting an image at the transfer point 160. FIG. 13 illustrates the secondary image transfer system 158 pivoted away from the primary image transfer belt 166 and the secondary image transfer belt 168 accelerated to the media web speed while cooperatively pivoting upwardly against the media web. The media web transfer point frame cooperatively pivots downwardly against the media web. FIG. 13 illustrates the image transfer to the media web. FIG. 14 illustrates the operation of the secondary image transfer system 158 subsequent to the media image transfer to the media web 153. As shown, the frame is pivoted downwardly, the secondary image transfer belt 168 is decelerated to the speed of the primary image transfer belt 166, and the primary and secondary image transfer belts are in contact for the next image transfer. In addition, the media web transfer frame 180 is pivoted upwardly to decouple/disengage from the media web 153.

Referring to FIG. 15, another embodiment of a printing module including a secondary image transfer system is illustrated. This exemplary embodiment includes a frame 210, toner supply containers 212, photo receptor modules 214, a primary image transfer belt 216, a media web input 218, a media web image transfer point 220 and a media web transport output 222. These members were described with reference to FIG. 11. FIG. 15 also includes a secondary image transfer system comprising a drum 224. The drum is an alternative arrangement for the secondary image transfer belt previously described.

Figure 16:
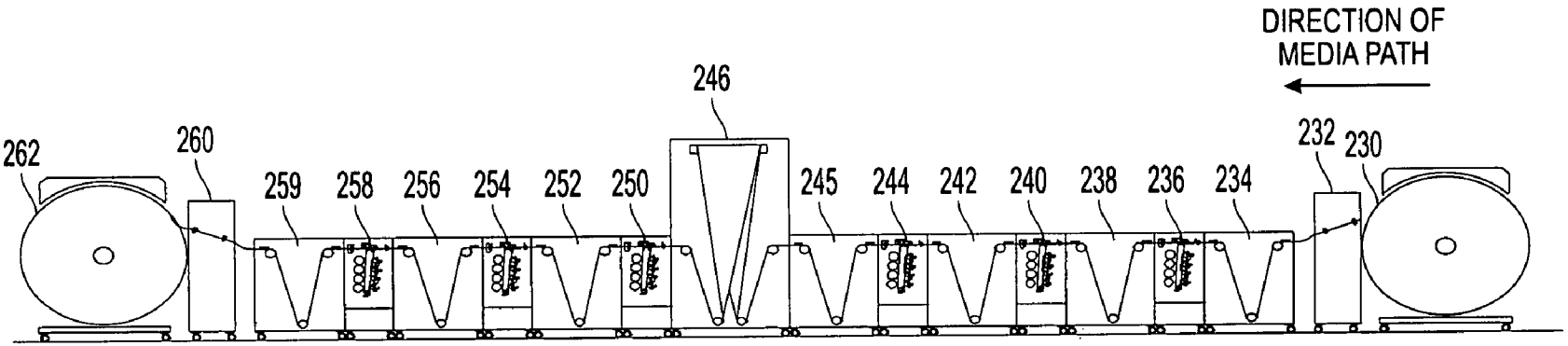
FIG. 16 illustrates a CF printing system according to an exemplary embodiment of this disclosure.

Referring to FIG. 16, another embodiment of a printing system is disclosed. This exemplary embodiment includes a media web feeder roll 230, a media web input adapter 232, media web buffers 234, 238, 242, 245, 252, 256 and 259, printing modules 236, 240, 244, 250, 254, and 258, a media web output adapter 260 and a media web output roll 262. In addition, the printing system includes a media web inverter 246 to invert the media web for duplex printing.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing system comprising:

a first printing module comprising:

an image transfer system configured to selectively mark a media web; and a media web transport system configured to selectively advance the media web without image marking by the image transfer system at a first speed and selectively route the media web for image marking by the image transfer system at a second speed, the first speed greater than the second speed;

a media web input; and a media web output; and a first media web buffer comprising:

a media web input;

a media web queuing space; and a media web output;

wherein the first printing module media web output is operatively connected to the first media web buffer media web input;

a second printing module comprising:

an image transfer system configured to selectively mark the media web; and the media web transport system configured to selectively advance a media web without image marking by the image transfer system at the first speed and selectively route the media web for image marking by the image transfer system at the second speed;

a media web input; and a media web output;

wherein the second printing module media web input is operatively connected to the first media web buffer output; and a controller, operatively connected to the first printing module, the second printing module and the first media web buffer, the controller configured to store instructions, that when executed by the controller, cause the controller to perform a method comprising:

decoupling the image transfer systems associated with the first and second printing modules from the media web routed through the first printing module, the first media web buffer and the second printing module;

loading the first media web buffer with a first predetermined length of media web from a media web roll at the first speed, the predetermined length substantially equivalent to N sequential images associated with a print job;

coupling the image transfer systems associated with the first and second printing modules to the media web;

marking a first group of N consecutive images, in their entirety, on the first predetermined length of media web at the second speed using the second printing module, the first predetermined length of media web fed from the first media web buffer to the second printing module, and simultaneously marking a second group of N consecutive images in their entirety on a second predetermined length of media web at substantially the second speed using the first printing module, the second predetermined length of media web fed to the first printing module from the media web roll associated with the media web and substantially equivalent to N sequential images associated with the print job, the first and second predetermined lengths of media web substantially equal in length and the second speed less than the first speed.

2. The printing system according to claim 1, further comprising:

a second media web buffer comprising:

a media web input;

a media web queuing space; and a media web output;

wherein the media web input is operatively connected to the second printing module media web output;

a third printing module comprising:

an image transfer system configured to selectively mark the media web;

a media web transport system configured to selectively advance the media web without image marking by the image transfer system at the first speed and selectively route the media web for image marking by the image transfer system at the second speed;

a media web input; and a media web output;

wherein the third printing module media web input is operatively connected to the second media web buffer output; and the controller is operatively connected to the first printing module, the second printing module, the third printing module, the first media web buffer, and the second media web buffer, the controller configured to store instructions, that when executed by the controller, cause the controller to perform a method comprising:

decoupling the image transfer systems associated with the first, second and third printing modules from the media web routed through the first printing module, the first media web buffer, the second printing module, the second print media buffer and the third printing module;

loading each of the first and second media web buffers with a length of media web equivalent to the first predetermined length from the media web roll at the first speed, the predetermined length substantially equivalent to N sequential images associated with a print job;

coupling the image transfer systems associated with the first, second and third printing modules to the media web;

marking N consecutive images on the first predetermined length of media web loaded in the second media web buffer at the second speed using the third printing module, the length of media web fed from the second media web buffer to the third printing module, simultaneously marking N consecutive images on the first predetermined length of media web loaded in the first media web buffer at the second speed using the second printing module, the length of media web fed from the first media web buffer to the second printing module, and simultaneously marking N consecutive images on the second predetermined length of media web at substantially the second speed using the first printing module, the second predetermined length of media web fed to the first printing module from the media web roll associated with the media web, the first and second predetermined lengths of media web substantially equal in length and the second speed less than the first speed.

3. The printing system according to claim 1, wherein the controller is configured to store instructions, that when executed by the controller, cause the controller to perform the method further comprising:

(a) receiving a document print job;

(b) processing the document print job to determine specific attributes associated with the document print job;

(c) determining the number of sequential images, N, to be image marked by said printing modules based on the attributes; and (d) adjusting said buffer to hold the first predetermined length of media web substantially equivalent to N sequential images.

4. The printing system according to claim 3, wherein the controller is configured to store instructions, that when executed by the controller, cause the controller to perform the method further comprising:

e) determining if the document print job is completed subsequent to the step of marking N consecutive images on the media web;

f) if the document print job is complete, ending the printing process;

if the document print job is not complete, advancing the media web at the first speed to align unprinted sections of the media web with the printing modules;

coupling the printing modules to the media web for image marking;

marking N consecutive images on the media web with each printing module, the media web advancing at the second speed; and decoupling the printing modules from the media web.

5. The printing system according to claim 4, wherein the controller is configured to store instructions, that when executed by the controller, cause the controller to perform the method further comprising:

repeating steps e) and f) until the document print job is completed.

6. The printing system according to claim 1, wherein the first and second printing modules are one of a monochrome printing module and a color printing module.

7. The printing system according to claim 1, further comprising:

a media web inverter.

* * * * *